United States Patent [19]

McCarthy

[11] Patent Number: 4,703,571

[45] Date of Patent: Nov. 3, 1987

[54] CALENDAR/FILE/MEMO SYSTEMS

[76] Inventor: Francis W. McCarthy, 165 B. 134th St., Belle Harbor, N.Y. 11694

[21] Appl. No.: 828,990

[22] Filed: Feb. 13, 1986

[51] Int. Cl.[4] ..... G09D 3/00

[52] U.S. Cl. ..... 40/107; 40/120; 40/122

[58] Field of Search ..... 40/107, 359, 371, 120, 40/373, 122; 283/2, 3; 312/234.5, 234, 183

[56] References Cited

U.S. PATENT DOCUMENTS

| | | | |
|---|---|---|---|
| Re. 22,839 | 2/1947 | Potter | 283/2 |
| 355,209 | 12/1886 | Rimington | 40/107 |
| 376,506 | 1/1888 | Bate | 283/2 |
| 377,335 | 1/1888 | Smith | 40/107 |
| 669,319 | 3/1901 | Dailey | 283/2 |
| 792,641 | 6/1905 | Wilber | 40/122 |
| 1,293,013 | 2/1919 | Brady | 283/2 |
| 1,415,883 | 5/1922 | Lewis | 40/2 R |
| 1,507,345 | 9/1924 | Doyle | 40/121 |
| 1,641,600 | 9/1927 | Ormond | 312/183 |
| 1,798,656 | 3/1931 | Chapman | 283/3 |
| 1,848,634 | 3/1932 | Kruger | 40/107 |
| 2,027,286 | 1/1936 | Pendergast | 40/107 |
| 2,340,153 | 1/1944 | Stewart | 40/107 |
| 2,626,819 | 1/1953 | Winford | 283/2 |
| 2,889,036 | 6/1959 | Davies | 40/122 |
| 2,892,275 | 6/1959 | Woofter | 40/122 |
| 3,473,249 | 10/1969 | Ankrum | 40/107 |
| 4,218,077 | 8/1980 | Ember | 283/2 |
| 4,488,366 | 12/1984 | Hockensmith | 40/119 |

*Primary Examiner*—John J. Wilson
*Assistant Examiner*—Cary E. Stone
*Attorney, Agent, or Firm*—Morgan & Finnegan

[57] ABSTRACT

There is disclosed a calendar/file/memo system provided with a housing dimensioned to permit hanging on a wall, and having an opening at the top to receive a multi-panel, accordian-folded sheet which serves as a calendar/memo/pad or diary, and at the same time, as a folder for storing sheet material such as notes, cards, memos and invoices. Cutouts in the front face of the housing provide access for viewing of and for making notations on the exposed calendar/pad face and the backs of the panels preferably bear ruling lines or other notation for entry of data.

9 Claims, 6 Drawing Figures

CALENDAR/FILE/MEMO SYSTEMS

This invention relates to a combined calendar, file and memo system.

BACKGROUND OF THE INVENTION

A wide variety of calendars and calendar-diary combination are known. Such calendars include annual calendars and multi-year calendars provided with sequential displays to properly indicate the months, years, weeks and days and in some instances even make provision for other functions such as the diarying or logging of particular information, such as birthdays, anniversies or the like or other important information.

U.S. Pat. No. 1,415,883, for example, discloses a multi-year desk or memorandum calendar having a separate sheet for each day of the year. Beside the month and day date, e.g., "AUG. 5", each sheet includes a list of days of the week and corresponding year, e.g., "Friday 1921"; "Saturday 1922"; etc., so that each sheet may be used several times for successive years. A portion of each page is provided for the entry or diarying of information.

A perpetual calendar is disclosed in U.S. Pat. No. 1,848,634 which includes a base member foldable transversely at two points dividing the same into three 2 sided panels, the faces of each panel carrying two month designations and associated week day designations "S, M, T, W. . . ", but no numerical date. A separate flexible numerical date-carrying strip is provided which has printed on its face a matrix of numbers in rows and columns, so arranged that when properly positioned on a selected panel of the base member, the combination correctly displays the date sequence for the selected month. The calendar also includes a transverse endless coverband cooperating with the numerical date strip to conceal certain invalid numerals when desired and to provide support functions. No functions other than a perpetual calendar are apparent.

U.S. Pat. No. 2,027,286 discloses a calendar date sheet in the form of a folded, U-shaped sheet for three months imprinted on each face of each panel of the U so that any set of 3 months can be displayed by rotating the U configuration 180 degrees and/or turning it inside out. The upper ends of the U are releasably held together by a folded clamping member. The only additional functions apparent in this reference are the provisions of space for perpetual advertisements and for annotations.

Another perpetual calendar is disclosed in U.S. Pat. No. 2,340,153 which provides a calendar which in its pattern of association of the days of the week with days of the month presents the appearance of an ordinary calendar, whether showing a single month of the current year or a sequence of months. Unlike an ordinary design, this calendar does not expire at the end of a year or other period. Without recourse to any external data, the calendar can be set perpetually. Structurally, the calendar takes the form of twenty-one cards, seven of which are year cards, referred to as masks and fourteen of which are month-cards, twelve of which represent the twelve months of any year other than leap years and the thirteenth and fourteenth of which represent January and February of leap years only. When the proper year card is aligned over the proper month card, the opening in the year card exposes the correct number of days for that month and year, in sequence, and the correct designation of the days of the week - the visible effect being that of the ordinary calendar. Multiple functions are not apparent although there is sufficient border space for annotations.

Another arrangement known in the field of calendars is a constant reminder memorandum device of the type disclosed in U.S. Pat. No. 4,218,077. The calendar includes chart means for the recording of special events and means for facilitating retrieval of such recorded events. In a preferred form, a single chart serves as a reminder of events and enables the user to see events for a period of six months at one time; in an expaneded form six charts are utilized to provide more space for recording events to be remembered.

Finally, in U.S. Pat. No. 4,488,366, there is disclosed a calendar with a combined display of consecutive months which optionally includes a support or cover means. The calendar structure includes linking apparatus for displaying in a linked and continuing fashion, time sequences shown on separate pages thereof. The individual pages are provided with specific hinging structures to permit simultaneous viewing of the last portion of one month and the first portion of the next month, so that a continuous display is provided for linked time sequences notwithstanding the fact that such sequences are provided on separate pages.

While some of the foregoing prior art calendars also serve as a calendar/memo pad or diary, none of them provide, at the same time, a storage function for storing sheet material such as notes, cards, memos, invoices and the like. Nor do they provide a calendar arranged for the easy transferral of notations such as birthdates, from one year to the next and in which the backs of the calendar panels are arranged to facilitate annotations and the making of a complete log. There exists, therefore, a need for calendars and/or reminder devices which provide such features and the present invention fulfills such a need.

BRIEF STATEMENT OF THE INVENTION

Generally, in accordance with the invention in its broadest aspect, there is provided a calendar/file/memo system comprising a slipcase-like housing dimensioned to permit hanging on a wall, and having an opening at the top to receive a multi-panel, accordion-folded sheet which serves as a calendar/memo pad or diary, and, at the same time, and in cooperation with the housing, as a folder for storing sheet material such as notes, cards, memos, invoices and the like. Cutouts or widows in the front face of the housing provide access for viewing and for making notations on the exposed calendar/pad face. Preferably, the back faces of the calendar panels also bear ruling lines or other notation facilitating entry of data.

THE DRAWINGS

In order to describe the inventive calendar/file/-memo system more fully, reference is directed to the accompanying drawings which are to be taken in conjunction with the following detailed description thereof and in which drawings.

DESCRIPTION OF THE PREFERRED EMBODIMENTS

Figure 1:
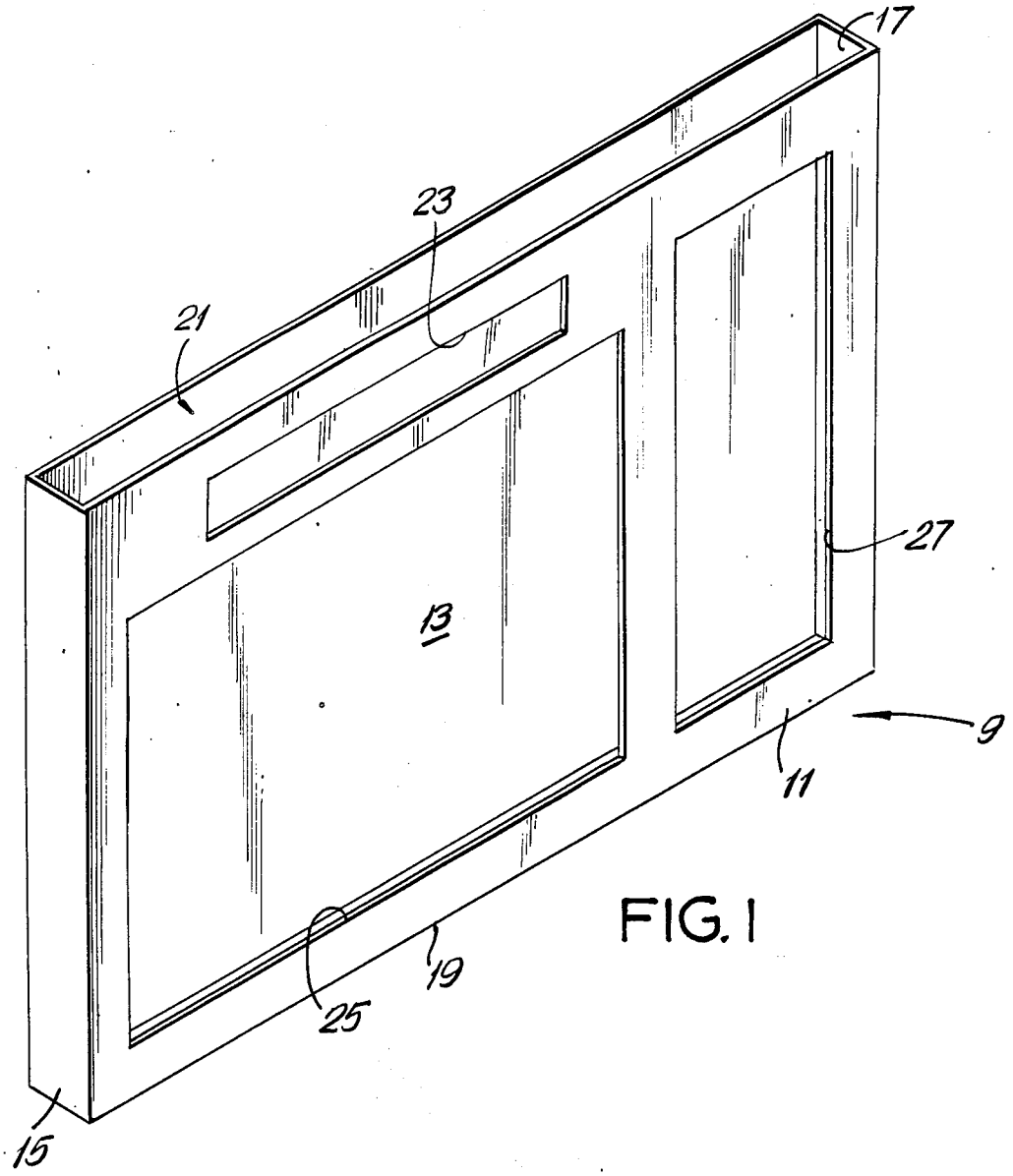
FIG. 1 is a view in elevation and perspective of the housing of the invention showing the windows or cutouts in the front face thereof and the opening at the top through which the multi-panel, accordion-folded calendar sheet is inserted and removed.

Referring now more particularly to FIG. 1, the housing 9 shown there comprises a front member or face 11 and a back member 13 which are connected to each other in a spaced relationship along three of their corresponding edges by side members 15, 17 and 19. Front member or face 11 and back member 13 of housing 9 along with side members 15 and 17 form an opening 21 for insertion into and removal from the housing of a multi-panel, accordion-folded sheet which serves as a calendar/memo pad or diary, and, at the same time, as a folder system for storing sheet material, as described in more detail hereinafter.

Front member 11 is also provided with a plurality of cutouts or windows 23, 25 and 27 positioned therein to provide access for viewing and for making notations on the calendar/pad or diary face.

Housing 9 can be made of a wide variety of materials such as plastics, good quality heavy paper or cardboard and the like and may be colored in any desirable color or patterns of colors to provide a pleasing aesthetic appearance. If desired, on the other hand, the housing may be permitted to remain in an uncolored state and be simply provided with a slick or glazed surface finish. Alternatively, the solid portions of the front member or face 11 of the housing, whether or not provided with decorative coloring, may be utilized to carry advertising or other desired information.

The size of the housing is dimensioned to permit hanging on a wall and the size and number of cutouts, such as 23, 25 and 27 and their positioning in the front member or face 11 may also be varied, being dependent on the locations of the chronological calendar indicia and the space for making memos or diarying data on the calendar/pad face employed therewith. The height, width and depth of the calendar/pad face per se may also be adjusted as required. The housing 9 may conveniently be provided with a decorative cord or the like (not shown) for hanging from a wall; or a simple opening or openings (not shown) may be provided in the back member for reception of fasteners to fix the housing to a wall. Alternatively, the unit may be rested against a vertical surface or laid on a table or desk.

Figure 6:
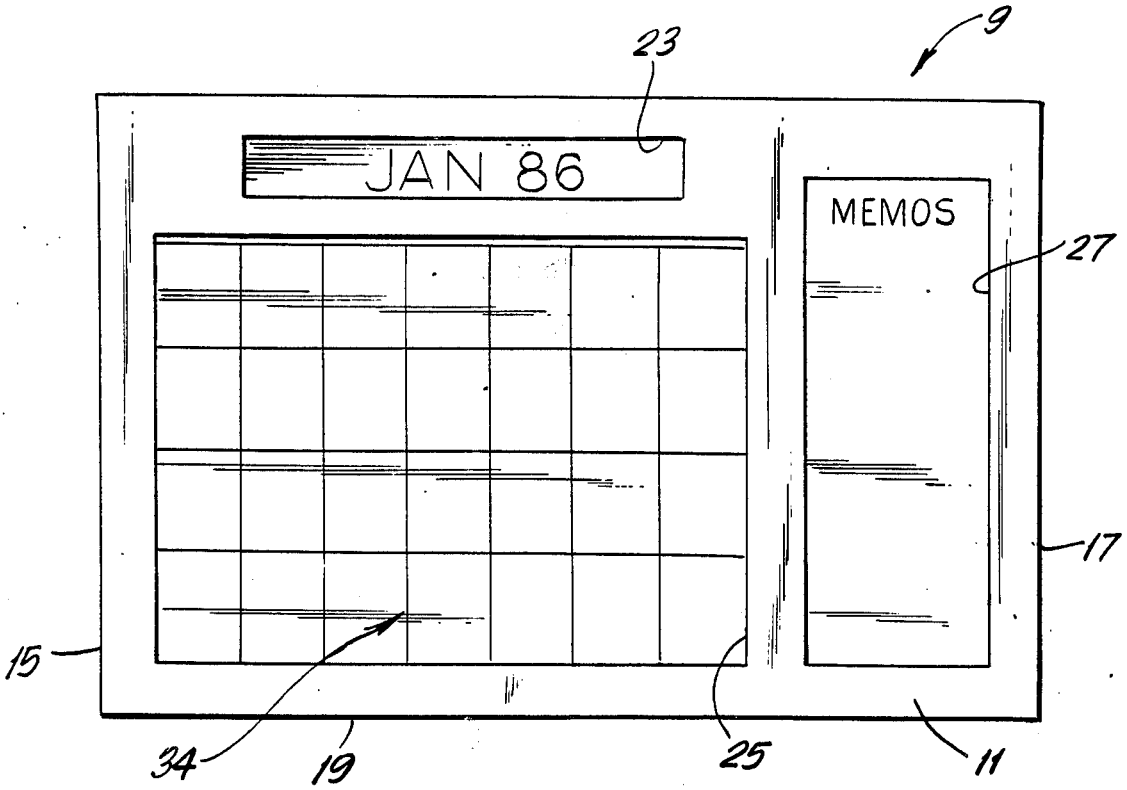
FIG. 6 is a view in elevation of the housing of FIG. 1 showing the multi-panel accordion-folded sheet illustrated in FIGS. 3 and 4.

As may be seen from FIG. 6, the housing shown in FIG. 1 has cutouts 23, 25 and 27 positioned in the front member or face 11 so that the calendar indicia or any memo data recorded on a calendar/pad face disposed therein are clearly and easily readable, the month and year being seen through cutout 23, the weeks and days of the month being seen through cutout 25 and the cutout 27 permitting ready access to the memo or diary space provided for logging data and viewing the same.

The muli-panel, accordion-folded set of sheets 34 which serve as a calendar/memo pad or diary, and, at the same time, as a member of the storage system, each comprise a plurality of separate panels, with each sheet covering a calendar quarter and each panel thereof covering a monthly period in an annual calendar. Four of such sheets 34, complete an annual twelve-month calendar period, or a lesser number of sheets may be used where the system is to cover a portion of an annual calendar. Where the system is to cover a multi-year period, the sheets have a sufficient number of panels to provide a panel of each month of each year covered.

Figure 2:
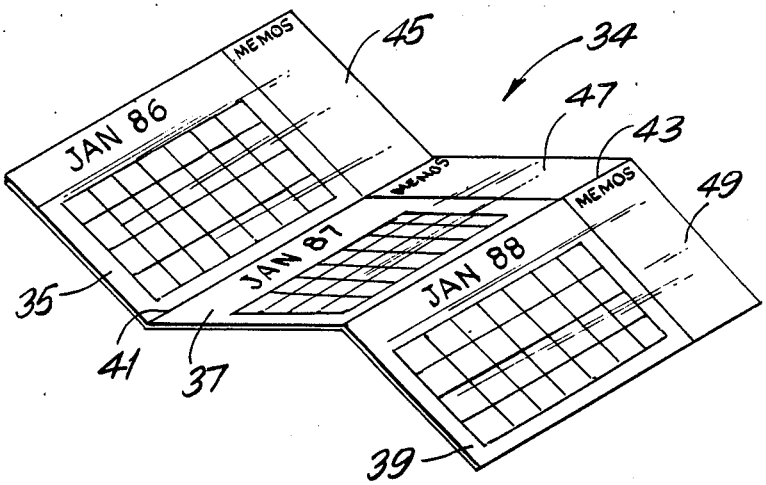
FIG. 2 is a perspective view of the multi-panel, accordion-folded calendar sheet showing a portion of a multi-year calendar covering a three-year period.

More specifically, as shown for a three year multi-year calendar in FIG. 2, the separate panels 35, 37 and 39 of sheet 34 represent particular time periods arranged in a first sequence, that is, the months of January for the years 1986, 1987 and 1988. The panels, three in number, are integrally formed from the sheet fold lines or score lines 41 and 43 disposed along the bottom of the first panel and the top and bottom of the successive panel. Each panel is provided with a plurality of rows arranged in a second sequence, that is, the weeks and days for the designated months, and each row identifies a third sequence of indicia representing specific time units, that is, the numerical dates for the days of the weeks set forth. Each of the panels is also provided with additional spaces 45, 47 and 49 for entry of important data.

Figure 3:
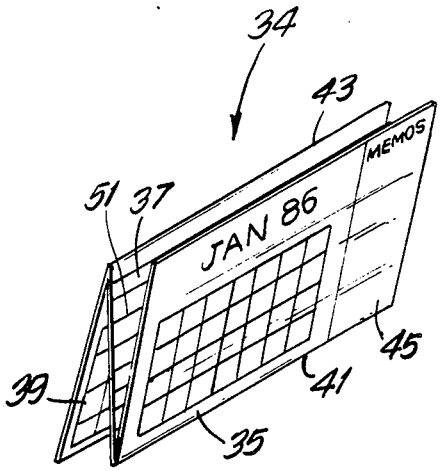
FIG. 3 is a perspective view of the sheet shown in FIG. 2 illustrating the same in a partially folded state to form a file folder and partially showing the ruled back of one of the panels to be employed as additional space for the entry of date.

The panels of each sheet when folded with respect to each other form a convenient file folder, as shown in FIG. 3, for storage of records, such as receipts, invoices, bills, tax records and the like and especially those items which relate to the appropriate time periods defined by the calendar panels. The backs of each of the panels of each sheet may also be used for the recording of more detailed information. In this connection, the backs of each panel are preferably ruled, as shown at 51 in FIG. 3, to permit convenient recording of such materials as they are logged thereon. The calendar/file/-memo system described provides not only a storage capability but also the means for keeping a lifetime permanent record of information with continuous use from year to year on a monthly basis for each year covered, as well as providing for the logging of a complete record on the backs of the panels.

It is to be understood, on the other hand, that it is within the purview of this invention that the calendar of the described system can be further sub-divided or broken down into weekly or bi-monthly segments. In such cases, there will be a greater number of sheets of panels, the total number of sheets being sufficient to complete the period of time to be covered.

It should also be understood that the descriptive embodiments of this invention as set forth herein are illustrative only and the concepts of this invention are not to be limited thereby, except as defined in the appended claims.

Figure 4:
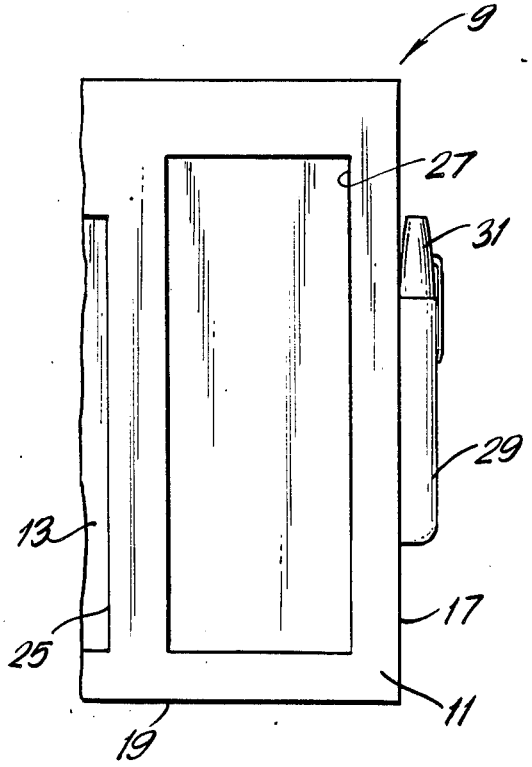
FIG. 4 is a partial view in elevation of the slipcase or housing illustrated in FIG. 1 showing a writing instrument and its support.
Figure 5:
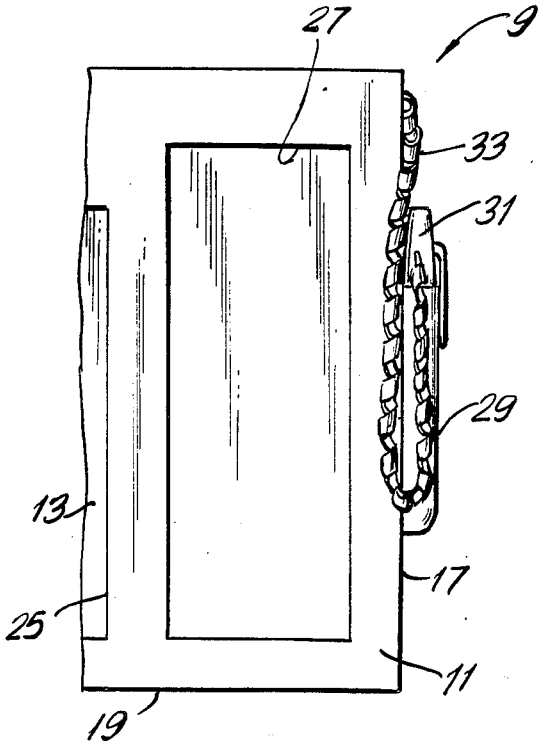
FIG. 5 is a partial view in elevation of the housing of FIG. 1 showing a writing instrument attached thereto by an extensible cord and also supported in a pocket similar to the pocket illustrated in FIG. 4.

In addition to serving as a component of the file arrangement, housing 9 may also provide support for a writing implement. For example, as may be seen from reference to FIG. 4, a holder or pocket 29 may be provided on side member 17 to support a pen 31. On the other hand, the pen 31 may be provided with an extensive, flexible cord 33 having one end attached thereto and the opposite end attached to side member 17, as shown in FIG. 5. In this embodiment of the calendar/-file/memo system of the invention, the pen or other recording device can simply be left hanging from cord 33, although it is generally preferred that the holder or pocket 29, as shown in FIG. 5, also be employed to support the pen.

What is claimed is

1. A combination calendar/file/memo system comprising a housing including a front member and a back member connected to each other in a spaced relationship along three of their corresponding edges by side members thus providing an opening, a multi-panel, folded member adapted to be disposed in said housing through said opening and imprinted as a calendar/-memo pad or diary, said folded member being configured as a folder for storing records, and a plurality of cutouts in the front member of said housing providing access for viewing of and for making notations on the exposed calendar/pad face.

2. A calendar/file/memo system according to claim 1 wherein said housing includes means for supporting a writing device.

3. A calendar/file/memo system according to claim 1 wherein said opening is at the top of said housing.

4. A calendar/file/memo system according to claim 1 wherein the side members of said housing cooperate with the panels of said folded member to form a storage compartment.

5. A calendar/file/memo system according to claim 1 wherein the panels of said folded member are arranged such that annotations thereon covering one period can be readily transferred to corresponding dates of another period.

6. A calendar/file/memo system according to claim 1 wherein said multi-panel, folded member comprises a plurality of separate panels representing particular time periods arranged in a first sequence on the faces thereof and which are connected to each other by hinging means disposed along the bottom of the first panel and the top and bottom of the succeeding panel, each panel having a plurality of rows arranged in a second sequence and each row identifying a third sequence of indicia representing specific time units on the face thereof, and each panel when hingedly folded with respect to a succeeding panel forming a file folder having its sides blocked by the sides of said housing to form a secure file for the storage of material.

7. A calendar/file/memo system according to claim 6 wherein the hinging means is a score line.

8. A calendar/file/memo system according to claim 6 wherein the backs of the panels bear ruling lines facilitating the entry of data.

9. A calendar/file/memo system according to claim 6 in which said folded member comprises four multi-panel, accordion-folded sheets, each sheet consisting of three panels hingedly connected to each other, and each panel representing one given month from January through December of a given year.

* * * * *